United States Patent [19]

Bash et al.

[11] 4,291,665

[45] Sep. 29, 1981

[54] PROPULSION DEVICE FOR SPHERICAL OBJECTS HAVING AN OSCILLATING SUPPORT FRAME PROVIDING A PROGRAMMED DISCHARGE OF SAID OBJECTS

[75] Inventors: C. Malcolm Bash, Roosevelt; Joseph Pasquito, Lawrenceville, both of N.J.

[73] Assignee: Prince Manufacturing Co., Inc., Princeton, N.J.

[21] Appl. No.: 88,434

[22] Filed: Oct. 26, 1979

[51] Int. Cl.[3] ..... F41F 1/04; A63B 69/38

[52] U.S. Cl. ..... 124/56; 74/48; 273/29 A

[58] Field of Search ..... 124/6, 7, 8, 9, 56, 124/71, 72, 75, 77, 78, 80, 83; 273/26 D, 29 A, 30; 74/48

[56] References Cited

U.S. PATENT DOCUMENTS

| | | | |
|---|---|---|---|
| 259,221 | 6/1882 | Selden | 74/48 X |
| 3,757,759 | 9/1973 | Haworth | 124/7 |
| 3,807,379 | 4/1974 | Vodinh | 273/26 D X |
| 3,855,988 | 12/1974 | Sweeton | 124/56 |
| 3,930,486 | 1/1976 | Kahelin | 124/75 |
| 4,002,336 | 1/1977 | Beaver et al. | 273/30 |
| 4,027,646 | 6/1977 | Sweeton | 124/56 |
| 4,046,131 | 9/1977 | Clark et al. | 124/71 |
| 4,086,903 | 5/1978 | Scott | 124/78 |
| 4,140,097 | 2/1979 | Lewis | 124/80 |
| 4,207,857 | 6/1980 | Balka, Jr. | 124/56 |

FOREIGN PATENT DOCUMENTS

| | | | |
|---|---|---|---|
| 2338716 | 8/1977 | France | 124/56 |

*Primary Examiner*—Richard T. Stouffer

*Attorney, Agent, or Firm*—John J. Kane; Frederick A. Zoda; Albert Sperry

[57] ABSTRACT

A propulsion device, designed especially but not necessarily solely for propelling tennis balls for training purposes, has in common with earlier devices a rotary distributor or magazine, feeding balls in successively following order into a discharge conduit. The balls are discharged through a barrel which is mounted upon the housing of the equipment for adjustment about a transverse axis, thus to dispose the barrel at selected positions of inclination, to vary the trajectory of the ball when propelled, with the adjustment being preserved after selection by the user.

An improved oscillatory motion is imparted to the entire device, hence to the barrel, following adjustment of the barrel to the selected position of inclination. The oscillatory travel is adapted to be programmed, that is to say, in oscillating the entire structure bodily, adjustments can be made that will permit pre-selection of the number of tennis balls to be propelled during each oscillatory cycle, other adjustments can be made with respect to the angle at which the discharge barrel is inclined, further adjustments can be made as to the width of the area within which the balls will drop, and still other adjustments can be made for pre-selection of a ball-drop pattern within a given width of training area. All of the adjustments can be effected singly or in any desired combination thereof, according to the training needs of the particular user.

10 Claims, 3 Drawing Figures

PROPULSION DEVICE FOR SPHERICAL OBJECTS HAVING AN OSCILLATING SUPPORT FRAME PROVIDING A PROGRAMMED DISCHARGE OF SAID OBJECTS

CROSS REFERENCE TO RELATED APPLICATIONS

The present application is related to co-pending application of C. Malcolm Bash, Ser. No. 955,852, filed Oct. 30, 1978, now U.S. Pat. No. 4,233,953 issued Nov. 18, 1980.

BACKGROUND OF THE INVENTION

1. Field Of The Invention

The present application falls in the general field of those training devices that are adapted to propel forcibly, into the air, spherical objects such as tennis balls or the like for practice or training purposes. In a more particular sense the invention relates to a means for imparting oscillatory motion bodily to an entire device of the character described, about an axis that, if not completely vertical, at least has a vertical component. The invention is directed to a programming-type improvement in ball-propulsion equipment already known, in respect to the means for creating oscillating motion of the discharge barrel of the equipment, thus to time the oscillation and the extent of angular travel thereof and in addition pre-select a ball-drop pattern in a given extent of such angular travel, relative to the successive discharge of the tennis balls during normal rotation of a distribution or feed magazine.

2. Description Of The Prior Art

Tennis ball propulsion devices, for use as training aids, are already very well known in and of themselves. A typical propulsion device of the type stated may be seen in U.S. Pat. No. 4,027,646 issued June 7, 1977. In such devices, there is a hopper, a rotary feed magazine or distributor having angularly spaced ball receiving openings or sleeves, and a conduit that extends from the distributor location to the discharge outlet of the device. Passage of a ball from the distributor through the conduit occurs within a pressurizing chamber, in such fashion that the balls are successively fed through the conduit. Pressure is built up behind each ball until it reaches a value such as to cause the ball to be forcibly discharged.

In the prior art, various means have heretofore been devised for changing or varying the path in which the successively propelled objects will be directed. It is known, for example, to cause the discharge barrel of such a device to be oscillated, that is, moved in a continuous back-and-forth or side-to-side motion, so that the user will be required to run back-and-forth across the tennis court, to return each ball, thereby to obtain practice in executing forehand as well as backhand strokes, increase his or her stamina, and otherwise obtain added benefits from the use of the propulsion device. See for example, Sweeton et al U.S. Pat. No. 4,006,726 issued to the assignee of the present application, and the patents cited therein.

The prior art devices have been effective in respect to achieving the broad objects of varying the paths along which the tennis balls or other spherical objects are discharged. However, the prior art has had certain disadvantages, including, for example, the provision of oscillatory motion only through the medium of expensive electrical, electronic, or complex mechanical devices.

Further, in the prior art such devices have in many instances been required to be built into the complete device, in such fashion that the user would be prevented from manufacturing, with the same components, both standard and programmed oscillating type discharge mechanisms.

In still other prior art devices, it has not been possible for a user to adjust, with maximum speed and ease, the width of the oscillating path in which the discharge end of the barrel is to travel. And in yet other cases the user is prevented from disengaging the oscillating mechanism except with considerable difficulty.

Thus, the prior art has broadly suggested the concept of timing oscillation of a discharge barrel in relation to the feeding of balls into the propulsion device, but heretofore, so far as is known, the prior art has not suggested a mechanical linkage between the ball feeding and the discharge mechanisms, such as to optionally connect or disconnect the oscillation-producing means, adjust swiftly and easily the extent of oscillating travel in relation to the quantum and frequency of ball delivery, and, in general, facilitate the manufacture of propulsion devices of this type so as to incorporate an oscillating mechanism that is inexpensive, simple, and trouble free, and that can be either incorporated in or left out of the propulsion device, according to the desires of the manufacturer and without changing in either instance the design or assembly of the basic propulsion device.

In the above-mentioned U.S. Pat. No. 4,233,953, the deficiencies of the prior art devices have been overcome by a programmable oscillating mechanism incorporated in a propulsion device of the character described. That device operates with full efficiency. The invention of U.S. Pat. No. 4,233,953, however, is directed to imparting oscillatory motion to the barrel assembly per se, while the rest of the structure remains stationary. While this is entirely suitable and feasible for incorporation in propulsion devices in which the barrel assembly is located at the top and to the rear portion of the equipment (as in U.S. Pat. No. 4,233,953), the mechanism of U.S. Pat. No. 4,233,953 is not adapted for use on propulsion devices of the kind shown in U.S. Pat. No. 4,027,646. In those devices the barrel is mounted at the front end of and near the bottom of the support structure or housing of the propulsion equipment.

SUMMARY OF THE INVENTION

Summarized briefly, the improvement comprising the present invention is incorporated in a propulsion device of the type disclosed and claimed in U.S. Pat. No. 4,027,646. That device includes a portable housing, containing a pressurizing chamber and a ball feed hopper located above said chamber. A rotary distributor mounted in the bottom of the hopper has a series of angularly spaced ball-receiving sleeves through which the balls are fed from the hopper. As the distributor rotates, it passes over a feed opening extending into the pressurizing chamber. The balls are thus successively delivered from the distributor into the chamber. Within the chamber they are directed in following order into a receiver and are then discharged forcibly from a barrel mounted upon the front end of the pressurizing chamber for adjustment about a horizontal transverse axis.

The oscillating mechanism disclosed in the above-mentioned U.S. Pat. No. 4,233,953 is incorporated in a propulsion device having the same general characteristics as that of U.S. Pat. No. 4,027,646, but which differs from the device of the latter patent in that the barrel is located at the top of and toward the rear end of the ball feed hopper. The oscillating mechanism of the parent application is adapted to permit a wide range of programmed or pre-selected ball-drop patterns, including pre-selection of an adjusted width of training area, programming of the ball drop pattern within any of said pre-selected areas, selection of the number of tennis balls to be propelled in a single oscillatory cycle, and pre-selection of the angle or trajectory at which the balls are discharged.

The present invention incorporates all the advantages of the oscillating mechanism of the parent application, in a propulsion device of the type shown in the above-mentioned U.S. Pat. No. 4,027,646. To this end, the present invention includes, in association with a propulsion device of the kind shown in said patent, a stationary support foot, to which is swivelly connected the lower end of a crank element rotatably mounted on the rear walls of the pressurizing chamber and ball feed hopper, a link pivotally connected to the crank element above the hopper, a rotary member to which the link is connectible at selected locations on said member, and a means of connecting the rotary member to the ballfeed distributor for rotation therewith. As a result, upon rotation of the ball-feed distributor during the normal operation of the propulsion device, said member is correspondingly rotated, and as a result imparts oscillatory motion to the link by reason of connection of the link to said member at any of various locations radially spaced from the axis of rotation of the member. The link is so joined to the crank element as to rotate the same, whereby to impart an oscillatory throw to the crank arm thereof. Since the crank arm is connected to the rotary foot, this is translated into oscillation of the entire structure, that is, the pressurizing chamber, barrel and hopper oscillate as one. Oscillation of the discharge barrel is thus achieved, and is effected with all the programming type adjustments previously noted herein.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
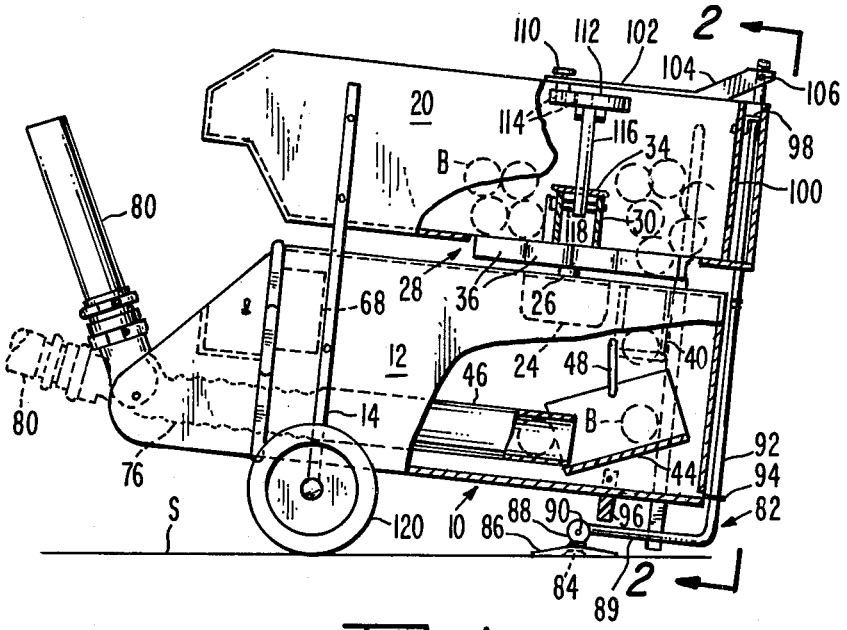
FIG. 1 is a view of a propulsion device equipped with the oscillating means of the present invention, said propulsion device being shown partly in side elevation and partly in longitudinal section, the barrel being shown in full and dotted lines in typical positions to which it can be adjusted to vary the trajectory of the propelled ball.

It is appropriate, for a full understanding of the present invention, to include a basic description of the construction and operating characteristics of the ball propulsion device in which the present invention is incorporated. This device is disclosed in full detail in U.S. Pat. No. 4,027,646, and the disclosure of that patent is understood as being incorporated by reference in the present application.

The ball propulsion device 10 includes a cylindrical pressurizing chamber 12 supported above the ground or other supporting surface S in a position inclined a few degrees from the horizontal through the provision of front support legs 14 disposed in embracing relation to the chamber 12 and riveted, bolted, or otherwise secured to said chamber. The legs 14 project upwardly above chamber 12, in embracing relation to hopper 20, to which the supports are riveted or otherwise fixedly secured. Hopper 20 is open at its top, to receive a supply of tennis balls B.

Mounted within housing 12 is a gear motor 24, secured fixedly to the top portion of housing 12, and having a stub shaft 26 projecting upwardly to engage, for rotation with the stub shaft, a depending hub of a distributor 28 preferably formed as an integral, molded plastic member to include a centrally disposed, upstanding, hollow, large diameter boss or projection 30 extending upwardly within the hopper to prevent "bridging" of balls within the hopper. Projection 30 is hollow, but in use is closed by a cap 34. The projection 30 extends upwardly into the hopper and when rotated during operation of the gear motor will agitate the balls to assure that they will fall into uniformly angularly spaced distributor sleeves 36 disposed about the projection 30 at the base thereof in a circular pattern.

A ball B will feed gravitationally through any sleeve 36 that becomes aligned with a ball feed sleeve 40 fixedly secured within chamber 12, and will fall onto a ramp or feed channel 44 fixedly mounted upon the rear end of an elongated receiver tube 46.

Hingedly mounted upon the lower end of ball feed sleeve 40 is a closure 48 free to gravitate to an open position thereof, but moving to a closed position when the chamber is pressurized.

Air is drawn into chamber 12 by a blower 68 to pressurize the same.

A flexible discharge tube 76 at its front end receives the inlet end of an elongated barrel 80, through which the balls B are discharged. When pressure builds up to a predetermined extent, a ball will be discharged.

In a device as described briefly above, and disclosed in full detail in U.S. Pat. No. 4,027,646, there is incorporated, in accordance with the present invention, an oscillating mechanism generally designated 82. A pivot bracket bolt or pin 84 (FIGS. 1 and 2) mounts upon a stationary, circular, rubber foot 86, a swivel bracket 88 in the form of a U-shaped yoke or clevis, between the arms of which extend a pivot pin 90 pivotally connecting to the swivel bracket the forward or distal end of a crank arm 89 integral at its rear, proximal end with the lower end of an elongated pivot shaft 92 journaled in an elongated bearing plate 94 fixedly secured to the rear end of the pressurizing chamber 12. An anti-flex support block 96, preferably of low-friction material such as nylon, is fixedly secured to and extends downwardly from the bottom of the chamber 12 (see FIG. 2).

The upper end portion of the pivot shaft 92 is journaled in an upper bearing 98 fixedly secured to and extending rearwardly from back wall 100 of feed hopper 20. At its upper end, the pivot shaft projects above the top edge of the hopper, as best shown in FIG.

Figure 3:
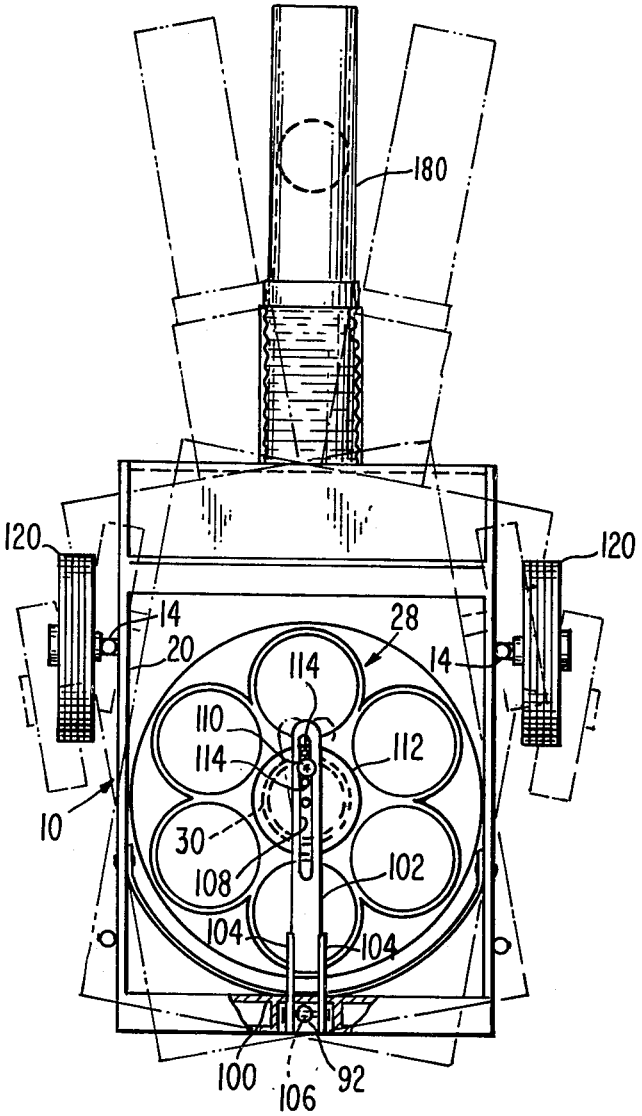
FIG. 3 is a top plan view of the propulsion device and oscillating mechanism, a portion being shown in section, the chain-dotted lines showing the ball propulsion device in opposite extreme positions to which it is oscillated during use.

1, and is pivotally connected to the rear end of a connecting link 102, said link having transversely spaced wings 104 embracing the upper end of the pivot shaft, and connected to the shaft through the provision of a pin 106 extending between the wings through the upper end of the shaft. Referring to FIG. 3, connecting link 102, at its forward extremity, is formed with an elongated, closed, longitudinal slot 108, adapted to receive a drop pin 110 insertible through the slot into any of a plurality of openings 114 formed in a rotary member 112 which in the present instance, but not necessarily is of circular configuration.

Figure 2:
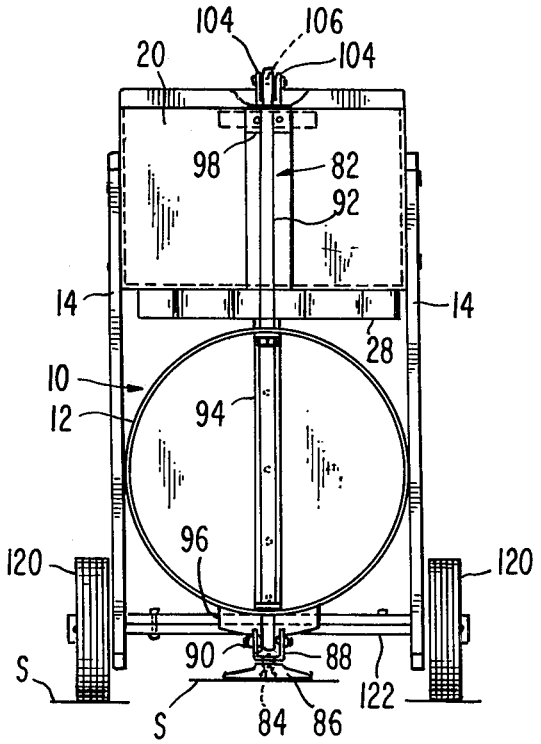
FIG. 2 is an enlarged rear elevational view, a portion being broken away, of the ball propulsion device and the oscillating mechanism, as seen from line 2—2 of FIG. 1.

Referring to FIG. 1, the member 112 is secured to the upper end of an extension shaft 116, that extends within the hopper, said member 112 being connected to the extension shaft for rotation therewith in any of various selected positions of angular adjustment of the member 112 in respect to the annular series of ball feed sleeves 40 of distributor 28.

Shaft 116, at its lower end, is extended through a center opening formed in cap 34, into the projection 30 of the distributor. Within the distributor, shaft 116 is secured to the distributor for rotation therewith through the provision of a cross pin 118.

In accordance with the present invention, it is desirable that the propulsion device 10 be rollably mounted, not only to facilitate its transportation to or from its place of use, but also to facilitate its oscillatory motion. To this end, ground wheels 120 are provided upon the lower ends of the legs 14, said wheels being mounted upon an axle 122 extended between and journaled in the legs.

It may be noted that the oscillating mechanism comprising the slotted link 102, drop pin 110, member 112, and extension shaft 116, are like those of U.S. Pat. No. 4,233,953, that is to say, the member 112 would be provided with openings 114 that can be arranged in the various patterns illustrated by way of example in said co-pending application. Similarly, the exterior configuration of member 112 can be varied, as again disclosed in detail in said application. Also, the member 112 can be adjustably secured to the upper end of the shaft 116, for angular adjustment of member 112 in respect to the distribution. An adjustment of 30° of member 112, for example, changes significantly the location at which the tennis balls will be discharged during each oscillating cycle. All of this has been described in full detail in U.S. Pat. No. 4,233,953.

OPERATION

In use of the device, the actual feeding of the tennis balls, and the forcible discharge therefrom, are effected as disclosed in U.S. Pat. No. 4,027,646. Further, the angle of inclination of the barrel, as for example between the full and dotted line positions shown in FIG. 1, are made as in said patent.

The actual programming of the apparatus to vary the number of balls propelled per oscillatory cycle, the intervals at which the balls will be propelled, the total angular, side-to-side distance traveled by the barrel for varying the width of the ball-drop pattern, and the variation of the ball-drop points within said pattern in each, selected total angular distance of oscillatory travel of the barrel, are all as disclosed in U.S. Pat. No. 4,233,953. They are hereby incorporated in the present application by reference to said U.S. Pat. No. 4,233,953.

In the present application, as previously noted, the entire apparatus is oscillated, as compared to oscillating only the barrel as in the co-pending application.

Thus, when the device has been moved to a selected training location, the rubber foot 86 will effectively grip the ground surface, and will remain wholly stationary during the operation. When motor 24 is energized, distributor 28 will be rotated, in turn rotating shaft 116. This rotates member 112, as a result of which oscillating travel of link 102 is effected.

The side-to-side, swinging motion of link 102 is translated into rotation of pivot shaft 92 about its longitudinal axis first in one direction, and then in the other direction as the link 102 moves back across center during the continued rotation of member 112.

The rotational movement of the pivot shaft imparts a swinging moment to crank arm 89. However the crank arm is connected by the pin 90 to clevis 88, which is permitted only rotational movement about the axis defined by pin 84 connecting the clevis to stationary foot 86. As a result, the force exerted upon the crank arm by the partial rotational movement of the pivot shaft 92 is translated into lateral swinging movement of the pivot shaft between opposite extreme positions shown by the two dotted line positions of the apparatus illustrated in FIG. 3. Wheels 120 move forwardly and rearwardly sufficiently to rotate for the purpose of permitting the bodily side-to-side swinging movement of the entire device. This is, of course, effective to correspondingly swing the barrel 80 from side-to-side, over a total angular distance determined by the particular aperture 114 in which drop pin 110 is removably engaged.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. In a propulsion device for spherical objects of the type including a propulsion chamber and a feed hopper overlying the same, said chamber and hopper comprising a frame structure, a rotary distributor within the hopper for feeding said objects in successively following order to the chamber, a discharge barrel communicating with said chamber, and means in the chamber for forcibly propelling said objects from the barrel, an improved device for imparting oscillating, side-to-side motion to the barrel, comprising:

(a) a pivot shaft mounted on the frame structure for rotation about its longitudinal axis;

(b) motion-translating means formed wholly as a mechanical driving linkage driven by the distributor and extending therefrom to the pivot shaft for imparting a predetermined quantum of rocking motion to the pivot shaft alternately in first one and then in the opposite direction, for every cycle of rotation of the distributor;

(c) a crank arm connected to the pivot shaft to rock therewith and extending radially from the pivot shaft whereby to impart a correspondingly predetermined quantum of oscillating motion to the crank arm in response to said rocking of the shaft in opposite directions; and (d) a stationary foot means to which the crank arm is connected at a location radially spaced from the rotational axis of the pivot shaft, whereby to impart mechanically a predetermined quantum of oscillating motion bodily to the pivot shaft, frame structure, and barrel as a mechanical response corresponding to each cycle of rotation of the distributor.

2. In a propulsion device for spherical objects of the type including a propulsion chamber and a feed hopper overlying the same, said chamber and hopper comprising a frame structure, a rotary distributor within the hopper for feeding said objects in successively following order to the chamber, a discharge barrel communicating with said chamber, and means in the chamber for forcibly propelling said objects from the barrel, an improved device for imparting oscillating, side-to-side motion to the barrel, comprising:

(a) an elongated pivot shaft mounted on the frame structure for rotation about its longitudinal axis;

(b) means connected between the distributor and the pivot shaft adapted to translate unidirectional rotation of the distributor into a rocking motion of the pivot shaft alternately in first one and then in the opposite direction;

(c) a crank arm rigid with and extending radially from the pivot shaft whereby to impart oscillating motion to the crank arm in response to said rocking of the shaft in opposite directions; and (d) a stationary foot means to which the crank arm is connected at a location radially spaced from the rotational axis of the pivot shaft, whereby to impart oscillating motion bodily to the pivot shaft, frame structure, and barrel responsive to oscillating movement of the crank arm, said frame structure being formed with front and rear ends, the barrel being mounted upon the front end of said structure and the pivot shaft being mounted upon the rear end thereof, said foot means being disposed intermediate opposite ends of the frame structure.

3. In a propulsion device for spherical objects, the improvement of claim 2 wherein the pivot shaft extends substantially the full height of the frame structure, the hopper having an open top and said motion translating means extending from the pivot shaft through the open top of the hopper to the distributor.

4. In a propulsion device for spherical objects, the improvement of claim 3 wherein the pivot shaft has upper and lower ends, said motion translating means being connected to the upper end of the pivot shaft and said crank arm being connected to the lower end thereof.

5. In a propulsion device for spherical objects, the improvement of claim 4 wherein the motion translating means comprises a link pivotally connected at one end to the upper end of the pivot shaft, a member connected to the distributor for rotation upon rotary movement of the distributor, said link being slidably, pivotally connected to said member at selected, adjusted locations spaced from the axis of rotation of said member, and means for angularly adjusting said member about the axis of rotation of the distributor.

6. In a propulsion device for spherical objects, the improvement of claim 5 wherein the foot means is disposed in underlying relation to said chamber, the crank arm being extended below said chamber and in spaced relation thereto, and having a swivel connection to the foot means.

7. In a propulsion device for spherical objects of the type including a propulsion chamber and a feed hopper overlying the same, said chamber and hopper comprising a frame structure, a rotary distributor within the hopper for feeding said objects in successively following order into the propulsion chamber in response to rotation of the distributor, a discharge barrel communicating with said chamber and mounted thereupon, and means in the chamber for forcibly propelling said objects from the barrel, an improved device for imparting oscillating, side-to-side motion to the barrel, comprising:

(a) an elongated pivot shaft, said chamber and hopper having rear end walls, the pivot shaft being mounted upon said end walls and having upper and lower ends projecting above the hopper and below the propulsion chamber, respectively;

(b) a motion translating connection between the rotary distributor and the pivot shaft, comprising an extension shaft on the distributor rotatable therewith, a rotary member secured to the extension shaft within the hopper, and a link slidably, pivotally connected to the rotary member near one end of the link and in radially spaced relation to the axis of rotation of said member, said link being connected to the pivot shaft at the other end of the link, whereby on rotation of said member said link will be imparted an oscillating motion and will rock the shaft first in one and then in the other direction upon the hopper and propulsion chamber;

(c) a crank arm secured to the pivot shaft and extending radially forwardly therefrom, whereby on rocking motion of the shaft said crank arm will be imparted oscillating motion, said crank arm underlying the propulsion chamber; and (d) a stationary foot means engageable with a surface upon which the frame structure is supported, said foot means having a swivel connection to the crank arm at a location spaced radially forwardly from the axis of rotation of the pivot shaft, whereby upon rocking of the shaft the frame structure will be imparted, bodily, an oscillating motion to in turn impart an oscillating motion to the discharge barrel.

8. In a propulsion device for spherical objects, the improvement of claim 7 wherein said frame structure includes ground wheels mounted forwardly of said foot means for rollably supporting the frame structure during oscillating movement thereof.

9. In a propulsion device for spherical objects, of the type including a frame structure having a propulsion chamber and a hopper, a discharge barrel mounted on the frame structure, a rotary distributor within the hopper for feeding spherical objects to the propulsion chamber, and means in the propulsion chamber for propelling said objects from the barrel, an improvement for imparting oscillating motion to the barrel comprising:

(a) means below the propulsion chamber for gripping a surface in which the propulsion device is supported; and (b) a motion translating mechanical driving linkage extending between the distributor and the gripping means, adapted for bodily imparting oscillating movement to the propulsion chamber, hopper, and barrel in response to rotation of the distributor, comprising a pivot shaft mounted on the frame structure, a link mechanically connected between the distributor and the rockshaft, said link being oscillated as a mechanical response to each rotation of the distributor for rocking the shaft first in one and then in the opposite direction, and a crank connected at one end to the shaft to rock therewith and anchored at its other end to the surface-gripping means for imparting a predetermined quantum of cyclic oscillatory motion bodily to the frame structure and the barrel mounted thereon as a mechanical response to each cycle of rotation of the distributor.

10. In a propulsion device for spherical objects of the type including a propulsion chamber, a hopper, a discharge barrel, a rotary distributor within the hopper for feeding spherical objects to the propulsion chamber, and means in the propulsion chamber for propelling said objects from the barrel, an improvement for imparting oscillating motion to the barrel comprising:

(a) means below the propulsion chamber for gripping a surface on which the propulsion device is supported; and (b) a motion translating connection between the distributor and the gripping means, adapted for bodily imparting oscillating movement to the propulsion chamber, hopper, and barrel in response to rotation of the distributor, the motion translating connection including a pivot shaft having a mechanical linkage to the distributor mechanically driven whereby and effective to rock the shaft as a mechanical response to rotation of the distributor, and a mechanical connection between the pivot shaft and said gripping means in the form of a crank arm for translating, wholly mechanically, rocking motion of the pivot shaft into a bodily side-to-side motion of the pivot shaft, said chamber and hopper together comprising a frame structure and the pivot shaft being mounted upon said frame structure whereby said frame structure and hence the discharge barrel will be imparted a side-to-side motion concurrently with the pivot shaft as a direct mechanical response to rotation of the distributor.

* * * * *